US007861726B1

(12) United States Patent
Lukasavitz

(10) Patent No.: US 7,861,726 B1
(45) Date of Patent: Jan. 4, 2011

(54) FILTRATION DEVICE FOR TOBACCO PRODUCTS

(76) Inventor: Steven J. Lukasavitz, 8720 14th Ave. S., Bloomington, MN (US) 55425

( * ) Notice: Subject to any disclaimer, the term of this patent is extended or adjusted under 35 U.S.C. 154(b) by 657 days.

(21) Appl. No.: 11/986,827

(22) Filed: Nov. 27, 2007

Related U.S. Application Data

(60) Provisional application No. 60/860,935, filed on Nov. 27, 2006.

(51) Int. Cl.
*A24D 1/12* (2006.01)
*A24F 13/02* (2006.01)

(52) U.S. Cl. ..... 131/175; 131/329; 131/238; 131/242; 131/271; 131/330; 131/189

(58) Field of Classification Search ..... None
See application file for complete search history.

(56) References Cited

U.S. PATENT DOCUMENTS 4,161,181 A 7/1979 Nicks et al.
4,369,798 A 1/1983 Jackson
4,671,300 A 6/1987 Grube et al.
5,497,791 A 3/1996 Bowen et al.
5,542,438 A 8/1996 Adams et al.
5,829,450 A 11/1998 Hicaro, Jr. et al.
RE36,106 E 2/1999 Bruno et al.
6,523,544 B1 2/2003 Ritter et al.

*Primary Examiner*—Philip C Tucker
*Assistant Examiner*—Phu H Nguyen
(74) *Attorney, Agent, or Firm*—Montgomery Patent and Design; Robert C. Montgomery

(57) ABSTRACT

A system and method for a cigarette smoke filtration device that reduces second-hand smoke and holds a lit cigarette while being smoked or sitting idle. The device somewhat resembles a bifurcated cigarette holder wherein a lit cigarette is placed within the device while being smoked or sitting idle. Once inside, the device draws the smoke from the cigarette through a filtering system reducing offending odors as well as most of the harmful gases from cigarette smoke. The filtering system has replaceable filter cartridges. The spent ashes are collected in the device's base which can be emptied as needed.

7 Claims, 5 Drawing Sheets

FILTRATION DEVICE FOR TOBACCO PRODUCTS

RELATED APPLICATIONS

The present invention was first described in and claims the benefit of U.S. Provisional Patent Application No. 60/860,935 filed on Nov. 27, 2006, the entire disclosures of which are incorporated herein by reference.

FIELD OF THE INVENTION

The present invention relates generally to a tobacco product filtration device and, more particularly, to said device reducing second hand smoke.

BACKGROUND OF THE INVENTION

There is much concern in our society about the dangers associated with second hand smoke. Accordingly, there is a need for a means by which smoke from cigarettes can be somewhat contained in order to reduce the effects of smoking on others. The development of the invention herein described fulfills this need.

U.S. Pat. No. 6,523,544 issued to Ritter discloses a fan-assisted ashtray. This patent does not appear to disclose a device that encapsulates a cigarette to prevent smoke from escaping and does not require a fan to direct smoke to the replaceable filter cartridge.

U.S. Pat. No. 5,829,450 issued to Hicaro, et al. discloses a device to control smoke dissipation by cigarettes. This patent does not appear to disclose a device that utilizes a replaceable filter cartridge to remove gas and other toxins from cigarette smoke.

U.S. Pat. No. 5,542,438 issued to Willard et al. discloses a smokeless ashtray system. This patent does not appear to disclose a device that does not require external electrical power to operate.

U.S. Pat. No. 5,497,791 issued to Bowen et al. discloses a smoker's accessory. This patent does not appear to disclose a device that does not require a power source nor does it disclose a device that does not require a fan.

U.S. Pat. No. 4,671,300 issued to Grube et al. discloses a smokeless ashtray. This patent does not appear to disclose a device that does not require a power source to operate a fan.

U.S. Pat. No. 4,369,798 issued to Jackson discloses a combination cigarette holder and cigarette smoke catcher. This patent does not appear to disclose a device that retains a cigarette in a holder on a surface and filters the smoke from the cigarette.

U.S. Pat. No. 4,161,181 issued to Nicks et al. discloses a smoke filtering ashtray. This patent does not appear to disclose a device that encapsulates a cigarette to prevent smoke from escaping and does not require a fan to direct smoke to the replaceable filter cartridge.

U.S. Pat. No. RE 36,106 issued to Bruno et al. discloses a smokeless ashtray. This patent does not appear to disclose a device that encapsulates a cigarette to prevent smoke from escaping and does not require a fan to direct smoke to the replaceable filter cartridge.

SUMMARY OF THE INVENTION

In view of the foregoing disadvantages inherent in the prior art, it has been observed that there is need for a device that filters and reduces second hand smoke from a cigarette.

The filtration device provides a convenient way to filter the smoke from a lit cigarette.

The filtration device when a lit cigarette or cigar is placed inside the device filters any escaping smoke or gases through a replaceable filter cartridge.

The filtration device comprises a bifurcated enclosure further comprising an upper and lower body portion.

The filtration device bifurcated enclosure may be constructed of any heat resistant material including but not limited to, injection molded plastic, wood and fiberglass.

The filtration device bifurcated enclosure may be provided in a variety of colors, styles or motifs to match other interior designs.

The filtration device bifurcated enclosure upper and lower body portions are connected by a hinge.

The filtration device further comprises an upper and lower body portion with latching edges which releasably engage to comprise the bifurcated enclosure.

The filtration device further comprises a holder that accepts the entry of the bifurcated enclosure.

The filtration device holder can maintain the bifurcated enclosure at any desired angle and depth of insertion.

The filtration device holder possesses non-skid foot pads to reduce sliding of the holder and to protect surfaces upon which the holder is placed.

The filtration device bifurcated enclosure further comprises an aperture for insertion of the cigarette, an upper and lower body portion with a conduit, a hinge, a replaceable filter cartridge, a stop mechanism and a vent.

The filtration device possesses a stop mechanism to prevent the replaceable filter cartridge from damage by the lit cigarette end.

The filtration device bifurcated enclosure provides an aperture for entry of the lit cigarette which then rests in the upper and lower conduit in the enclosure.

The filtration device possesses a replaceable filter whose size corresponds to the upper and lower portions of the bifurcated enclosure.

The filtration device comprises an integral recessed area incorporated into the lower conduit portion of the enclosure to receive the ash from the cigarette.

The filtration device possesses a replaceable filter cartridge composed of, but not limited to: electrostatically-charged polymer or synthetic fibers capable of removing smoke particles.

The filtration device possesses an air vent which is in communication with the filter cartridge and provides outflow of air out of the device.

The filtration device, in an alternate embodiment, may accept cigars through a specially designed bifurcated enclosure designed for cigars.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
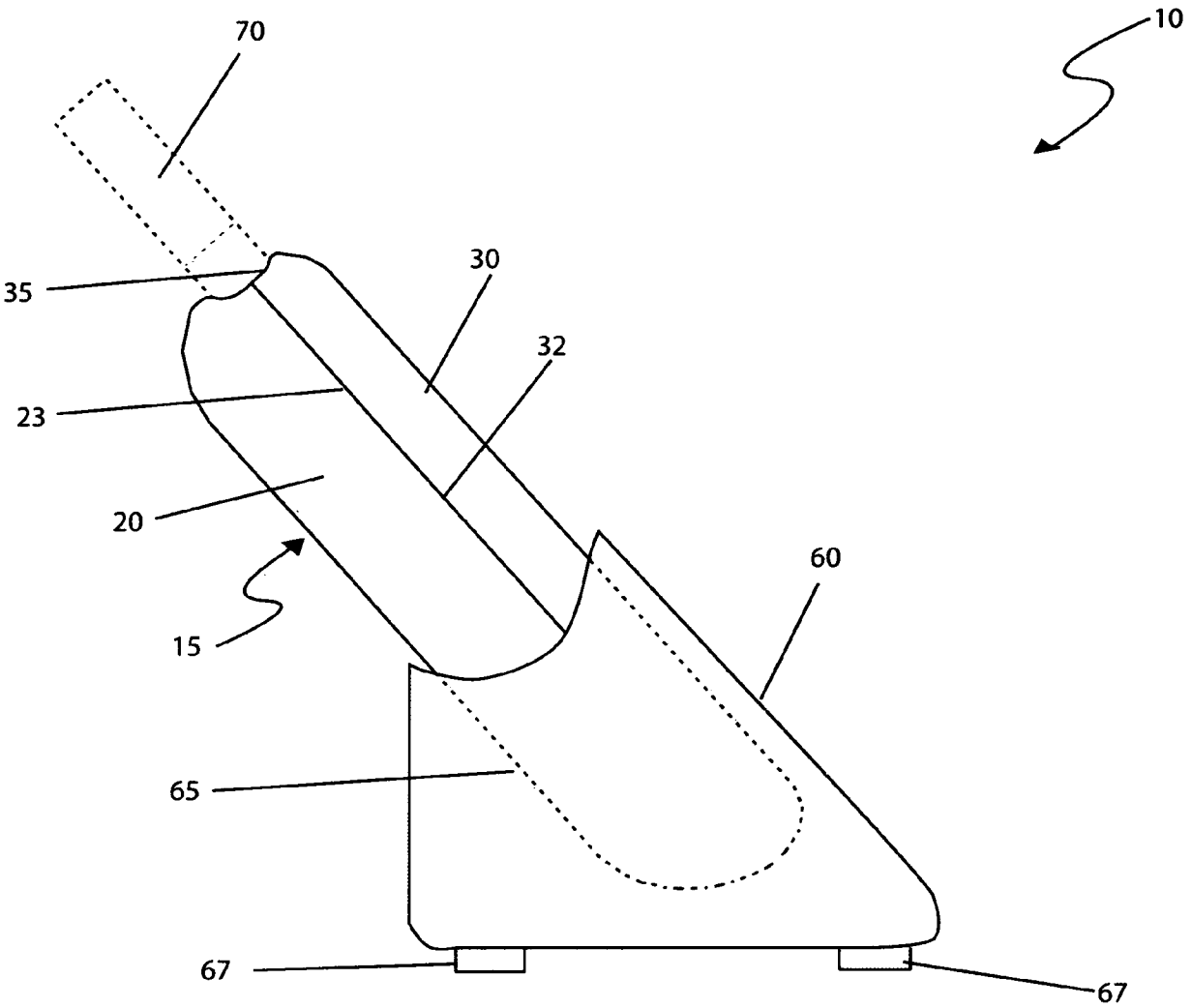
FIG. 1 is a side view of the filtration device for tobacco products 10 removably inserted therein a holder portion 60, according to the preferred embodiment of the present invention.

10 filtration device for tobacco products
20 lower body portion
21 lower conduit
22 ashtray
23 lower latching edge
25 hinge
30 upper body portion
31 upper conduit
32 upper latching edge
35 body aperture
40 filter cartridge
45 stop mechanism
50 air vent
60 holder
65 holder aperture
67 holder foot
70 cigarette
75 lit end
80 cigar embodiment
81 cigar enclosure
82 cigar embodiment upper body portion
83 cigar embodiment lower body portion
85 cigar

DETAILED DESCRIPTION OF THE PREFERRED EMBODIMENT

Figure 2A:
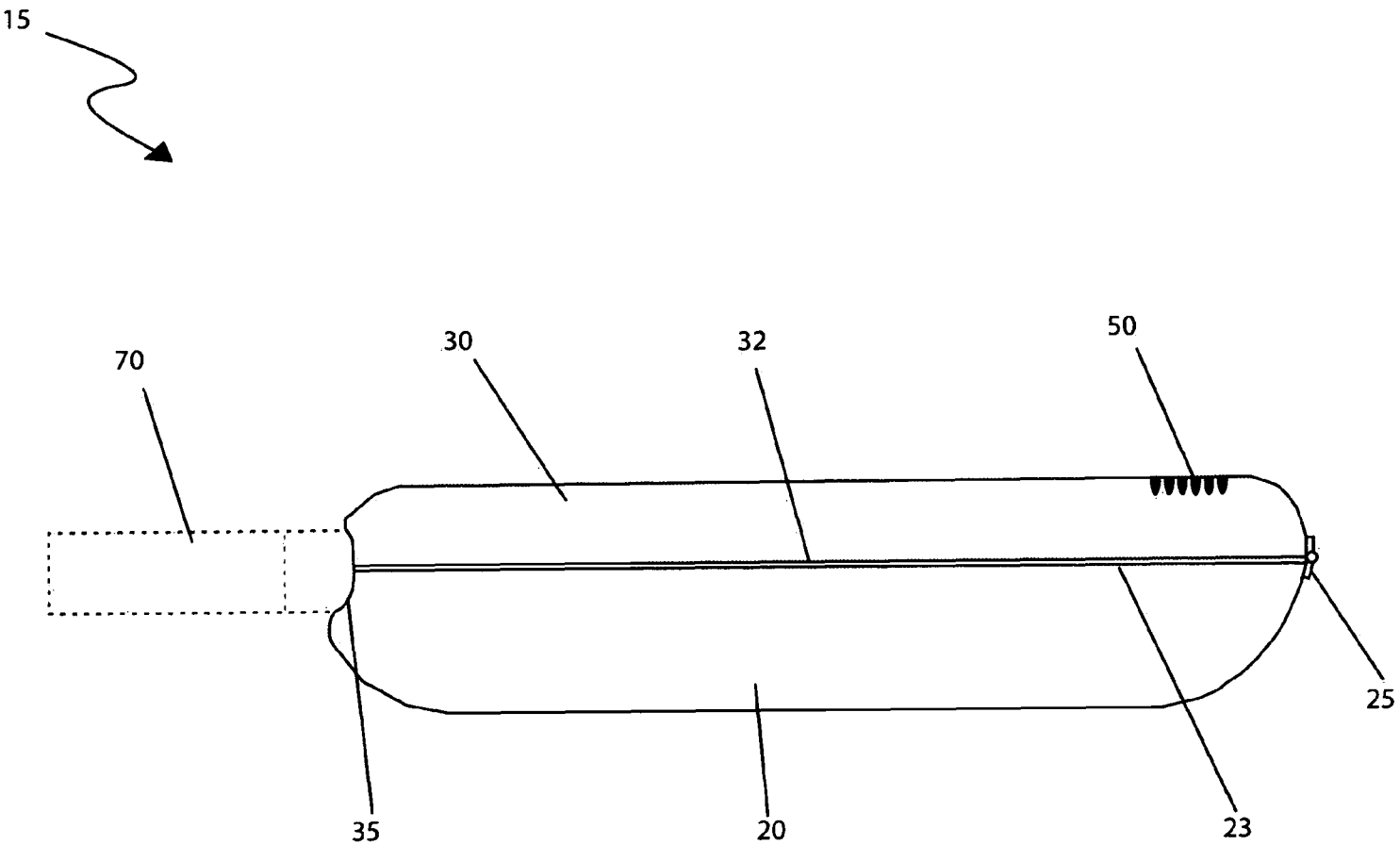
FIG. 2*a* is a side view of a filtration device for tobacco products 10 depicting a closed state, according to the preferred embodiment of the present invention.
Figure 2B:
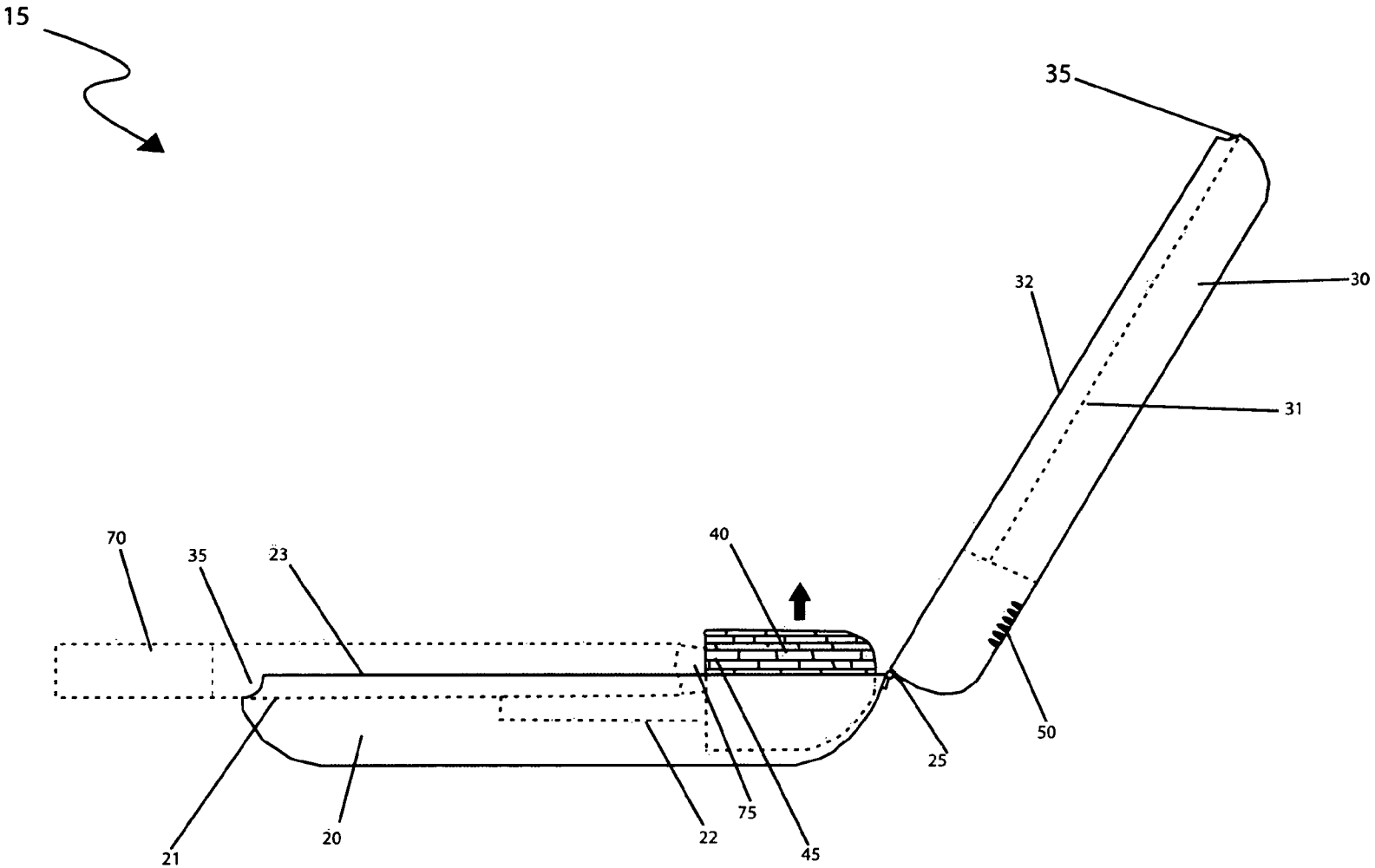
FIG. 2*b* is a side view of a filtration device for tobacco products 10 depicting an open state, according to the preferred embodiment of the present invention.
Figure 3:
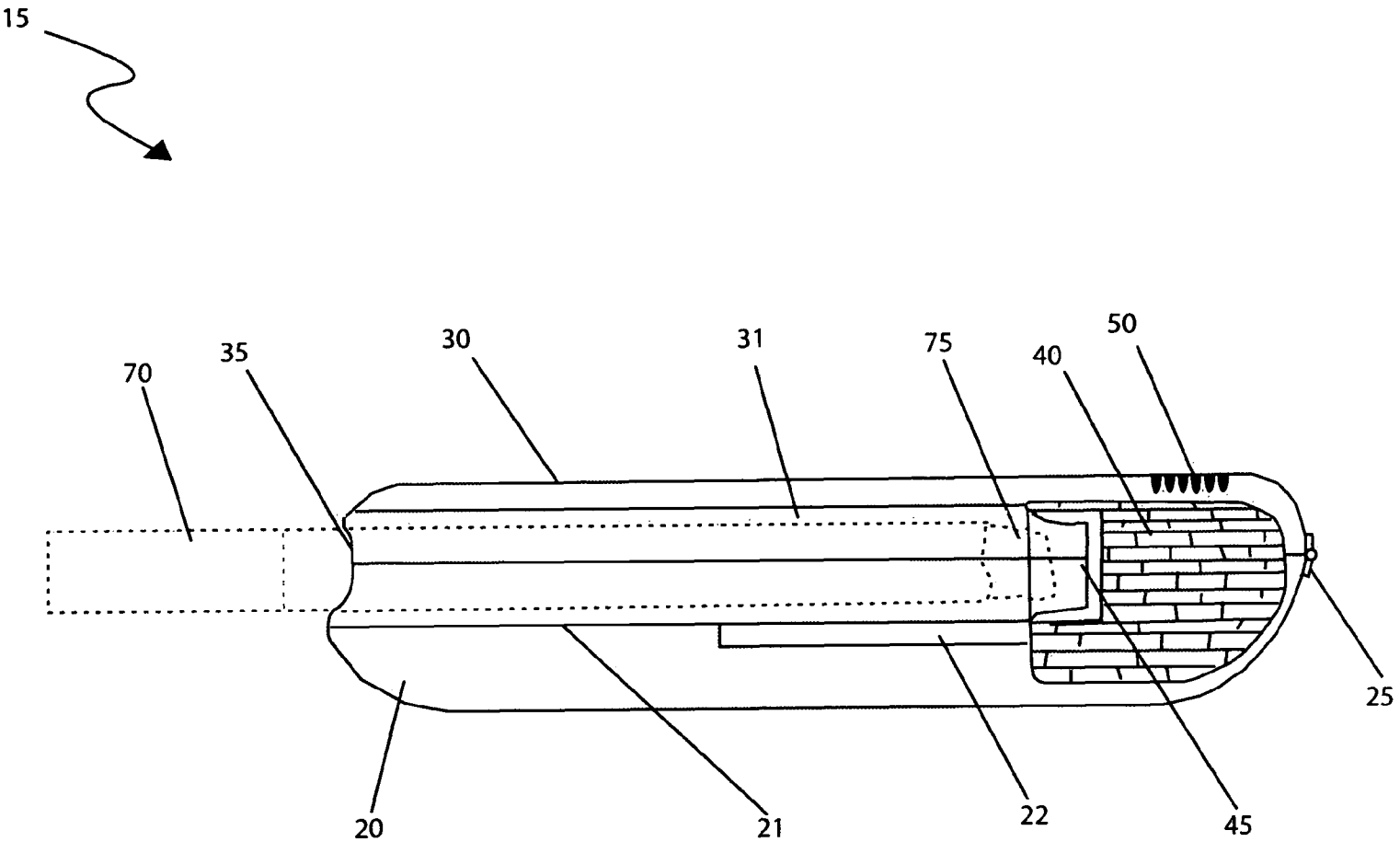
FIG. 3 is a cut-away side view of the filtration device for tobacco products 10, according to the preferred embodiment of the present invention; and, FIG. 4 is a side view of a filtration device for tobacco products 10 depicting a cigar embodiment 80, according to an alternate embodiment of the present invention.
Figure 4:
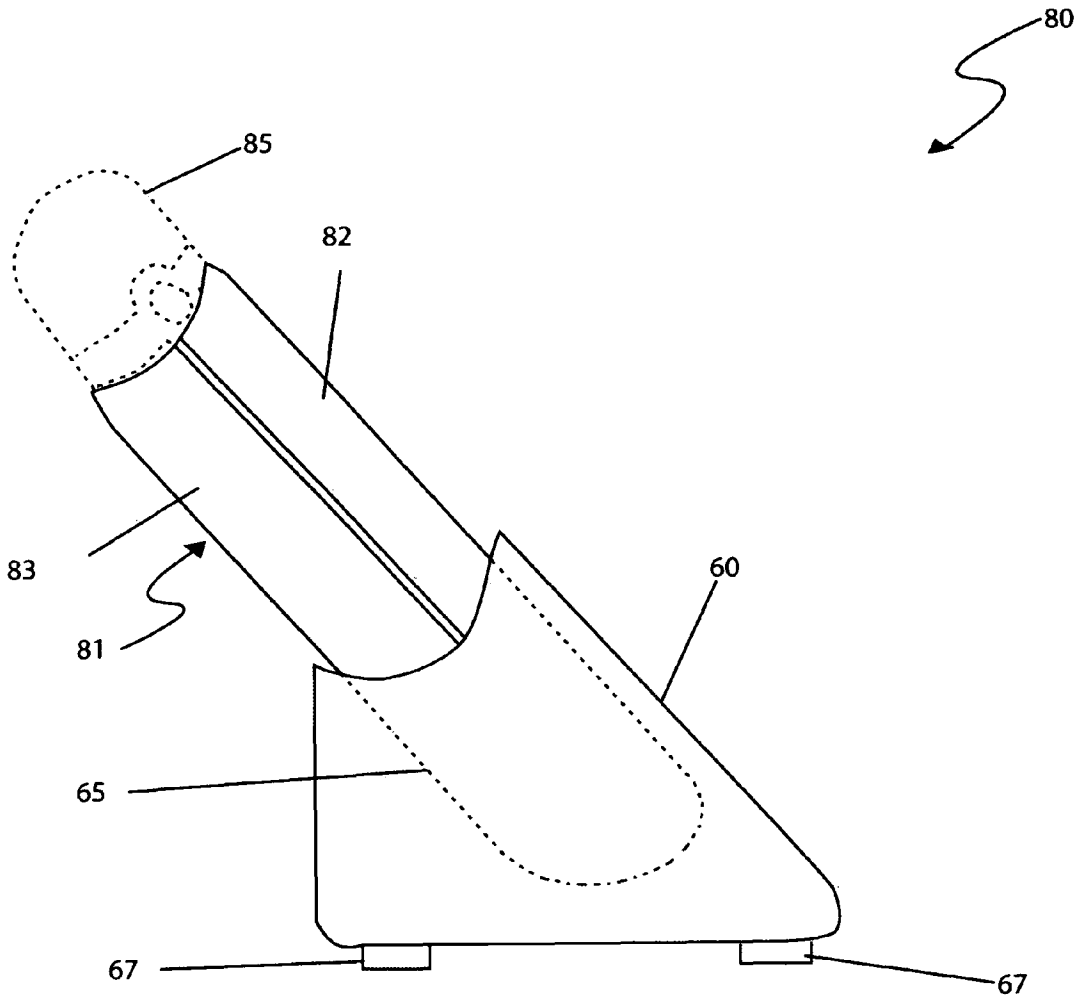

The best mode for carrying out the invention is presented in terms of its preferred embodiment, herein depicted within FIGS. 1 through 3 and in terms of its alternate embodiment depicted in FIG. 4. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a filtration device for tobacco products (herein described as the "device") 10, which reduces second-hand smoke and holds a lit cigarette 70 while being smoked or while sitting idle. The device 10 resembles a bifurcated cigarette holder in which a lit cigarette 70 is placed within. Once inside, the device 10 filters any escaping smoke or gases therefrom the cigarette 70 through a replaceable filter cartridge 40 reducing offending odors as well as most of the harmful gases from smoke. A holder 60 provides temporary storage of the device 10 upon a flat surface when idle.

Referring now to FIG. 1, a side view of the device 10 removably inserted therein a holder 60, according to the preferred embodiment of the present invention, is disclosed. The device 10 comprises a bifurcated plastic enclosure 15 further comprising a lower body portion 20 and an upper body portion 30. The lower 20 and upper 30 body portions of the device 10 are envisioned to be fabricated of plastic in an injection molding process requiring the design and use of custom molds; however, a plurality of heat-resistant materials such as metal, fiberglass, wood, or the like, may be used in the construction of the apparatus 10 providing equal benefit. It is envisioned that the device 10 may be introduced in a variety of attractive colors and patterns based upon a user's preference.

The enclosure 15 comprises a two (2) piece asymmetrically sized cylindrical housing being hinged together by means of an integral hinge 25 (see FIG. 2*a*). The lower 20 and upper 30 body portions further comprise a linear attachment means thereto one another via a pair of lower latching edges 23 and a pair of upper latching edges 32, respectively. Said latching edges 23, 32 are located along parallel outer edges of the enclosure 15 and provide a low-force snapping means comprising molded male and female latching features such to releasably engage interlocking regions to releasably fasten the two (2) body portions 20, 30 together. The device 10 further comprises a holder 60 to be used in conjunction therewith the enclosure 15 providing a holding and retaining means thereto. The holder 60 further comprises an internal holder aperture 65 designed to hold and retain the enclosure 15 at a specific angle and depth for easy removal of the enclosure 15 and the cigarette 70. Thus the holder aperture 65 provides a means for orienting the enclosure 15 relative to the holder 60 in which the enclosure 15 and, consequently the cigarette 70, are positioned to define an acute angle with respect to a horizontal surface. The enclosure 15 slidably inserts therein the holder 60 approximately one-half (½) to two-thirds (⅔) the depth of the holder 60 being guided and operably abutting thereagainst a lower end of the holder aperture 65 providing a slight frictional fit. The holder 60 also comprises four (4) rubber feet 67 along a lower surface to rest on a surface such as a table, desk or the like, thereby providing a frictional bond between the holder 60 and a surface. The holder 60 provides an attachment means thereto the holder feet 67 using adhesives or equivalent bonding means.

Referring now to FIGS. 2*a* and 2*b*, side views of the device 10 depicting closed and open states, respectively, according to the preferred embodiment of the present invention, are disclosed. The device 10 comprises a hinge 25 and a filter cartridge 40. The device 10 comprises a two (2) piece asymmetrically sized cylindrical enclosure being hinged together by means of an integral hinge 25. The hinge 25 provides a common rotating axial device providing a positioning means thereto the lower 20 and upper 30 body portions with respect to one another. The hinge 25 is envisioned being affixed thereto said lower 20 and upper 30 body portions using adhesives, integral molded features, rivets, or the like. Said body portions 20, 30 further comprise semi-circular openings incorporated therein located opposite the hinge end 25, which when in a closed state, define a circular open body aperture 35 having a diameter slightly larger than a cigarette 70. The body aperture 35 leads toward a lower conduit 21 and upper conduit 31 comprising a combined cylindrical shape having a diameter equal or slightly larger than that of a cigarette 70. The lower 21 and upper 31 conduit portions reside therewithin both lower 20 and upper 30 body portions, formed such that said lower 21 and upper 31 conduits form a cylindrical opening when the lower 20 and upper 30 body portions are pivotally closed using the hinge 25. The elongated conduit portions 21, 31 reside in interaction with the open body aperture 35 to regulate the insertion of the lit cigarette 70 and guide thereto a removably attachable and replaceable filter cartridge 40 further comprising a stop mechanism 45 therein providing a close fit thereto a lit end 75 of the cigarette 70.

Referring now to FIG. 3, a cut-away side view of the device 10, according to the preferred embodiment of the present invention, is disclosed. The lower 20 and upper 30 body portions define a cylindrical interior compartment for housing a filter cartridge 40. The filter cartridge 40 comprises a replaceable filter element envisioned to capture and retain smoke discharged from a lit cigarette 70. The filter cartridge 40 comprises an arcuate outer surface corresponding thereto that of interior features of the lower 20 and upper 30 body portions being at an adjacent position thereto the hinge 25. Said filter cartridge 40 comprises a particular size to operably capture smoke exuding therefrom a lit end 75 of a cigarette 70. The filter cartridge 40 further comprises a cylindrical inner stop mechanism 45 which provides a receiving and stopping means thereto the lit end 75 of the cigarette 70 at a sufficient distance therefrom the body aperture 35 such that the cigarette 70 protrudes outwardly from said body aperture 35 for easy grasping by a user. The stop mechanism 45 a cylindrical porous receiver providing an engaging means thereto the lit end 75 of the cigarette 70 so as not to damage the filter cartridge 40 and to prevent said cigarette 70 from passing entirely through the conduits 21, 31 thus providing a means for limiting the insertion of the cigarette 70 beyond a certain limit. Therefore, the unburned portion of the cigarette 70 remains within the conduits 21, 31. In this manner, the lit end 75 of the cigarette 70 will expel the ash or other burning material thereto an ashtray 22. The ashtray 22 comprises an integral linear recessed area incorporated therein the lower conduit 21 for the deposit and removal of spent ashes therefrom a cigarette 70. Any ash or other burnt materials may be trapped therein the ashtray 22 until operably removing the upper body portion 30 to empty said ashtray 22. Therefore, the smoke, odors, ash, burnt materials, or other matter emitted from a cigarette 70 remain trapped therein the filter cartridge 40 and/or ashtray 22 until the filter cartridge 40 is changed and/or the ashtray 22 is emptied.

The filter cartridge 40 is envisioned to comprise effective smoke filtering agents such as, but not limited to: electrostatically-charged polymer fibers, synthetic filter materials, and/or other suitable filter materials sufficient to remove smoke particles emitted therefrom the cigarette 70 in an expected manner. The filter cartridge 40 provides a particular size and design for the even distribution of smoke over the filter cartridge surface 40 thus maintaining the efficiency and longevity of said filter cartridge 40. Additionally, the thickness of the filter cartridge 40 provides efficient smoke entrainment for efficient filtration. The filter cartridge 40 is utilized for the efficient odor and smoke removal emitted off a cigarette 70. The filter cartridge 40 is envisioned to remove particulate matter such as ashes and gases emitted off the cigarette 70. The lower 20 and upper 30 body portions may be selectively opened using the lower 23 and upper 32 latching edges for the replacement of the filter cartridge 40 as needed.

The upper body portion 30 also comprises an air vent 50 to provide a "fresh" airflow out of the apparatus 10 from the filter cartridge 40. The filtered air is expelled therethrough the air vent 50. The air vent 50 is in communication thereto the filter cartridge 40 and comprises a plurality of small openings along an upper surface of the upper body portion 30 envisioned to comprise any size and shape so as to define a means for limiting a flow of oxygen thereto yet unburned cigarette portions 70 while providing a fresh airflow in an outward direction.

Referring now to FIG. 4, side view of a cigar embodiment 80 of the device 10, according to an alternate embodiment of the present invention, is disclosed. The cigar embodiment 80 comprises a cigar enclosure 81, a cigar embodiment upper body portion 82, and a cigar embodiment lower body portion 83. The cigar embodiment 80 is proportionally sized and designed specifically for use with a cigar 85. The cigar embodiment 80 is envisioned to provide similar function, construction, and materials as the previously described preferred embodiment of the invention 10.

It is envisioned that other styles and configurations of the present invention can be easily incorporated into the teachings of the present invention, and only one particular configuration shall be shown and described for purposes of clarity and disclosure and not by way of limitation of scope.

The present invention can be utilized by the common user in a simple and effortless manner with little or no training. After initial purchase or acquisition of the device 10, it would be installed as indicated in FIG. 1, and alternately as indicated in FIG. 4.

The method of utilizing the preferred embodiment of the device 10 may be achieved by performing the following steps: shutting the enclosure 15 using the hinge 25 and securing said enclosure 15 using the latching edges 23, 32, as needed; inserting a cigarette 70 therethrough the body aperture 35 thereinto the lower 21 and upper 31 conduits residing therewithin; inserting the cigarette 70 until the lit end 75 contacts the stop mechanism 45 filtering emitted smoke propelled by the lit end 75 of the cigarette 70 using the filter cartridge 40; smoking a cigarette 70 therewithin the enclosure 15 by grasping external surfaces of said enclosure 15; smoking the cigarette 70 in a similar fashion to normal smoking while retained therewithin the enclosure 15; placing the enclosure 15 therewithin a pocket, if desired; placing the enclosure 15 within the holder 60; placing the holder 60 with enclosure 15 inserted therein, on a flat surface to achieve an acute angle thereof to allow the ashes of the cigarette 70 to fall into the internal ashtray 22; smoking the cigarette 70 as described until consumed; removing any remains of said spent cigarette 70; replacing spent cigarette 70 with a new cigarette, as desired; opening the two-piece body portions 20, 30 upon finishing smoking by manually releasing the latching edges 23, 32, thereby exposing the filter cartridge 40; removing a spent filter cartridge 40; dumping the ashtray 22 to rid the apparatus 10 of ash; replacing the filter cartridge 40, as needed with the new one; closing and securing the enclosure 15 using the lower 23 and upper 32 latching edges; placing the apparatus 10 therewithin a pocket, purse, or the holder 60, until needed again; and, benefiting from reduced pollutants, escaping smoke, and toxic gases emitted therefrom the cigarette 70 using the present invention 10.

The method of utilizing the alternate cigar embodiment 80 of the device 10 may be achieved by performing the identical steps described above while applying the alternate embodiment 80 thereto a cigar 85 in like manner.

The apparatus 10 provides a means to comfortably carry a cigarette 70 within a pocket or placing the apparatus 10 onto a holder 60 as desired. The apparatus 10 holds and retains the lit cigarette 70 therewithin the conduits 21, 31 having a filter cartridge 40 for filtration of cigarette smoke. Once the lit cigarette 70 is inside the device 10 the smoke passes from the cigarette 70 through a filter cartridge 40 reducing offending odors as well as most of the harmful gasses from cigarette 70 smoke. The spent ashes are collected in the base of the apparatus 10 in the ashtray 22 which can be emptied as needed. The upper body portion 30 is manually released therefrom the latching edges 23, 32 and pivoted therefrom the lower body portion 20 rotating about the hinge 25 allowing the replacement of the filter cartridge 40 and the emptying of the ashtray 22 as needed. The clean air exits therethrough air vent 50 upon leaving the filter cartridge 40.

The apparatus 10 permits a user to quickly stow away a lit cigarette 70 for later use or smoking said cigarette 70 while inserted therein the enclosure 15, thereby minimizing or preventing odors, gasses, ashes, or the like to be expelled to the surrounding environment. Any smoke produced from the cigarette 70 resting therewithin the apparatus 10 passes therethrough the filter cartridge 40 for an even distribution of smoke therethrough the filter cartridge 40. The size of the air vent 50 ensures the correct airflow velocity outward while entraining the smoke into the apparatus 10 still permitting easy deposition of ash in the ashtray 22. The apparatus 10 also may be viewed as a safety feature by extinguishing a flame and ensuring that butts or ashes do not fall outwardly.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tobacco product filtration device for reducing secondhand smoke and holding an ignited cigarette, said tobacco product filtration device comprising:

a bifurcated enclosure provided with a lower body portion and an upper body portion pivotally connected thereto, said enclosure having an aperture formed at a proximal end thereof and further defining a conduit between said lower and upper body portions such that said conduit maintains a diameter generally equal to a diameter of the cigarette;

a filter cartridge disposed within said enclosure;

a stop member seated at a distal end of said enclosure and disposed adjacent to said conduit such that said stop member abuts an ignited end of the cigarette; and, an ashtray integrally formed within said lower body portion and defining a linear recessed area beneath the ignited cigarette for receiving cigarette ashes therein;

wherein said filter cartridge is positioned at said distal end of said enclosure; and, wherein said enclosure is formed from non-flammable material.

2. The tobacco product filtration device of claim 1, wherein each of said lower and upper body portions is provided with a linear edge directly conjoined to each other when said lower and upper body portions are adapted to a closed position.

3. The tobacco product filtration device of claim 1, further comprising: a holder including an internal aperture in which said enclosure is removably and slidably positioned at an acute angle with respect to a horizontal surface.

4. The tobacco product filtration device of claim 1, wherein said filter cartridge comprises: an arcuate outer surface corresponding to interior surfaces of said lower and upper body portions respectively.

5. The tobacco product filtration device of claim 1, wherein said stop member is interfitted between the ignited end of the cigarette and said filter cartridge so that said filter cartridge is not damaged during extended use.

6. The tobacco product filtration device of claim 1, wherein said filter cartridge is formed from at least one material suitable for removing smoke particles from ambient air, said at least one suitable material being selected from the group consisting of electrostatically-charged polymer fibers, synthetic filter materials, and any combination thereof.

7. The tobacco product filtration device of claim 1, wherein said upper body portion comprises: an air vent for allowing filtered air to outwardly flow from said enclosure.

* * * * *